United States Patent [19]

Evers

[11] 4,349,344

[45] Sep. 14, 1982

[54] TUBE AND POUCH FORMING MANDREL ASSEMBLY

[75] Inventor: Jack R. Evers, Torrance, Calif.

[73] Assignee: Developak Corporation, Redondo Beach, Calif.

[21] Appl. No.: 152,756

[22] Filed: May 23, 1980

[51] Int. Cl.[3] ..... B31B 33/02

[52] U.S. Cl. ..... 493/11; 493/29; 493/250; 493/288; 493/302

[58] Field of Search ..... 493/11, 29, 22, 302, 493/288, 287, 250, 252; 52/505, 550, 551, 552, 555

[56] References Cited

U.S. PATENT DOCUMENTS

| | | | |
|---|---|---|---|
| 2,161,479 | 6/1939 | Luce | 493/250 X |
| 2,321,647 | 6/1943 | Brougham et al. | 493/11 |
| 2,521,007 | 9/1950 | Heinmets | 493/302 |
| 3,220,320 | 11/1965 | Brigham | 493/11 |
| 3,323,964 | 6/1967 | Young | 493/302 X |
| 3,432,986 | 3/1969 | Schneider et al. | 493/190 X |
| 4,220,077 | 9/1980 | Miller et al. | 493/11 |

*Primary Examiner*—James F. Coan
*Attorney, Agent, or Firm*—Charles E. Brown

[57] ABSTRACT

This relates to a mandrel assembly for forming a continuous web into individual pouches. The web is drawn onto a reciprocating mandrel through a suitable guide so as to have adjacent free edge portions. The free edge portions are sequentially heat sealed by a side sealer and the so formed continuous tube is sequentially pushed onto the mandrels carried by a turret, followed by the heat sealing closed of the forward most portion of the tube and then the cutting thereof from the tube. A drive is provided for reciprocating each mandrel and the drive constructed wherein the advance of each mandrel may be selectively varied. The web is preferably provided with suitable indicia printed thereon and in order that the indicia may be properly oriented with respect to each bag or pouch, there is an indicia or printing detector which functions to vary the advance of the mandrel upon each stroke thereof so as to maintain registration of the printing.

12 Claims, 13 Drawing Figures

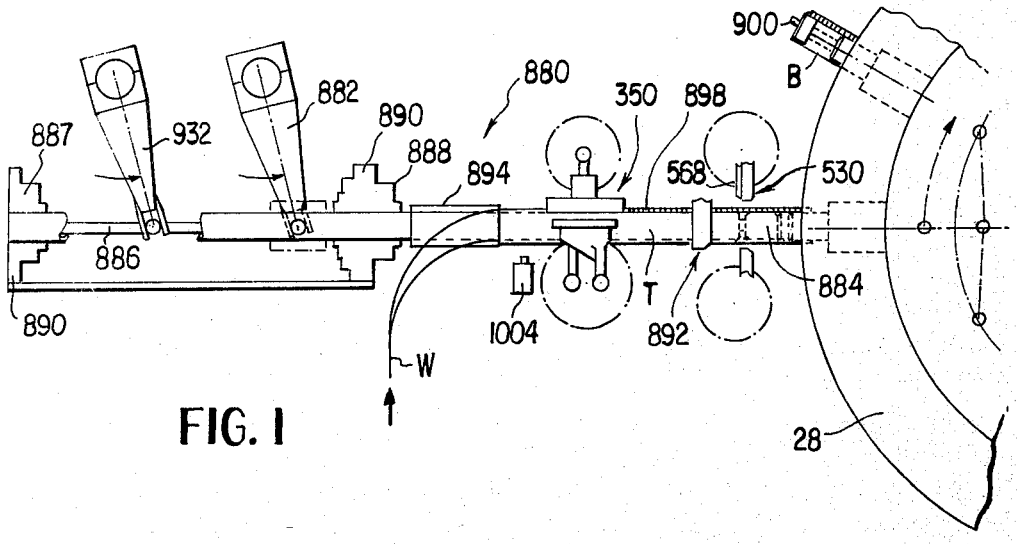
FIG. 1
FIG. 2
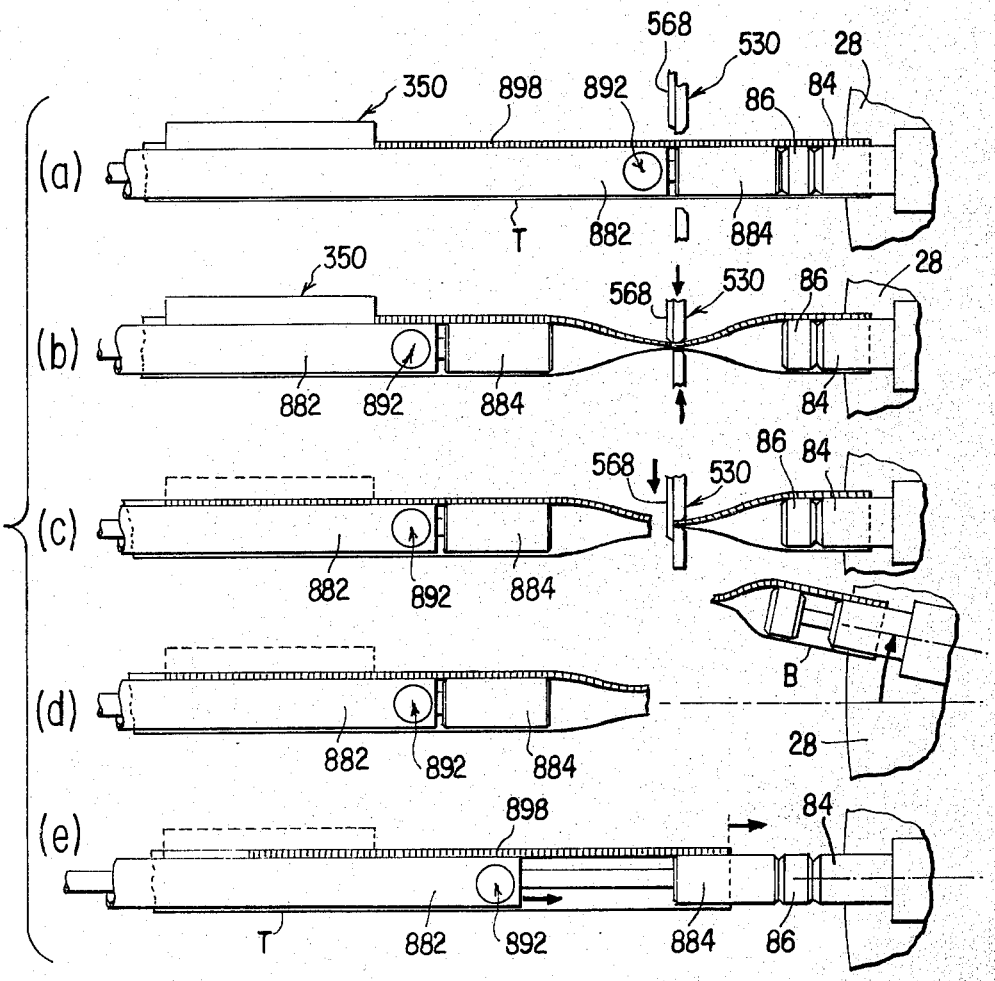

TUBE AND POUCH FORMING MANDREL ASSEMBLY

This invention relates in general to new and useful improvements in apparatus for forming from a continuous web sequentially pouches having sealed bottom ends, and more particularly to a mandrel assembly for forming the tube and sequentially advancing the same.

This invention in particular relates to a mandrel assembly wherein the mandrel assembly is utilized both as a support about which a web is shaped to form a tube and as means for advancing the tube in sequential steps.

Most particularly, this invention relates to the drive for the reciprocating mandrel, which drive is a cam actuated drive and includes linkage which oscillates a drive shaft to effect the reciprocation of the mandrel. The linkage is selectively adjustable to vary the advance stroke of the mandrel in accordance with the orientation of printing on the web whereby web registration is maintained.

Most particularly, the linkage includes a lever having a terminal pivot, and there being means for varying the position of the terminal pivot so as to change the effect of the linkage upon each actuation thereof by an associated cam.

In accordance with this invention there are provided two mandrel assemblies each with a separate drive whereby registration of printing on film carried thereby may be selectively achieved.

With the above, and other objects in view that will hereinafter appear, the nature of the invention will be more clearly understood by reference to the following detailed description, the appended claims and the several views illustrated in the accompanying drawing.

FIG. 1 is a schematic side elevational view of the pouch forming apparatus.

FIGS. 2*a*-2*e* are schematic elevational views showing the sequence of forming a pouch.

FIG. 3 in an enlarged side elevational view of the mandrel assembly with parts thereof broken away and other parts omitted for purposes of clarity.

Figures 3, 5:
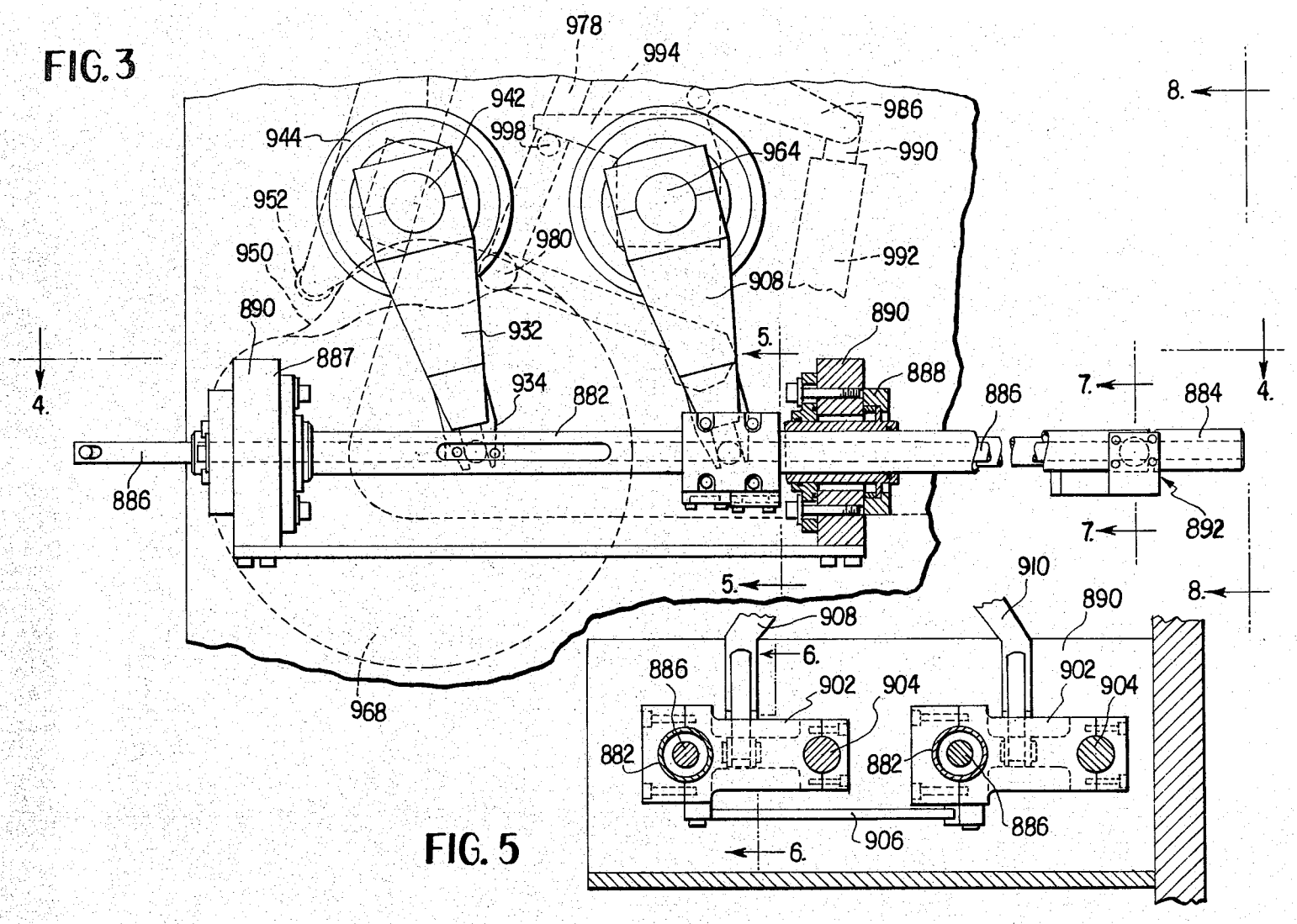
FIG. 5 is a transverse vertical sectional view taken generally along the line 5—5 of FIG. 3 and shows the details of the individual mandrels and the manner in which tube grippers are carried thereby.

Referring now to FIG. 1 in particular, it will be seen that the turret 28 of the machine is sequentially indexed so as to have an empty fixed mandrel 84 and an associated movable mandrel 86 positioned at the nine o'clock position for receiving a pouch B.

Each pouch is formed on and by a mandrel assembly which is generally identified by the numeral 880. Each mandrel assembly 880 includes a reciprocating mandrel 882 having at its forward end a mandrel extension 884 which is carried by a support rod 886. Each mandrel 882 is mounted for reciprocation within a pair of sleeve type supports 887 and 888 which are carried by horizontal supports 890 which extend forwardly from the main wall 54 of the machine.

The mandrel 882 has mounted on for reciprocation therewith a gripper, generally identified by the numeral 892. The gripper 892, as will be described hereinafter, is closed when the mandrel 882 is advanced and opened when the mandrel retracts.

A web W is supplied to the mandrel 882 through a suitable combination former and guide 894 so that the web is wrapped around the mandrel 892 in tube form with two parallel upstanding edges 896 initially in facing unsealed relation. The edges 896 are moved into alignment with and through a side sealer 350 so as to form on the resultant tube T a side seam 898.

After the leading portion of the tube T is fed over the movable mandrel 86 and onto the fixed mandrel 84, the tube is provided with a horizontally disposed transverse bottom seam 900 by the end sealer 530 after which is it cut from the remainder of the tube by a cutter 568.

Reference is now made to FIG. 2*a* wherein it is shown that the mandrel 882 and the mandrel extension 884 have advanced with the mandrel extension 884 engaging the movable mandrel 86 and the tube T is positioned for the formation at one end thereof of a pouch B. At this time the side sealer 350 is closed to additionally seal together further portions of the edge 896 to extend the side seam 898. At the same time, the gripper 892 is opened, as is illustrated by the dotted line position thereof.

Next, the mandrel 882 and the mandrel extension 884 retract, as is shown in FIG. 2*b*. The gripper 892 is now closed to fix the tube T on the mandrel 882 and the end sealer 530 is actuated to form the bottom seal 900.

With reference to FIG. 2*c*, it will be seen that the side sealer 350 is opened and the cutter 568 is actuated to sever the pouch B from the forward part of the tube T.

Referring now to FIG. 2*d*, it will be seen that the turret 28 is indexed while the mandrel 882 remains stationary. After a next movable mandrel 86 and fixed mandrel 84 is in the nine o'clock position, the mandrel extension 884 is first advanced to open the previously closed end of the tube T, followed by the advance of the mandrel 882 with the tube T gripped thereto by the gripper 892 to advance the tube to the position of FIG. 2*a* where the cycle is repeated.

It is to be understood that in accordance with this invention there are two mandrels 892 so as to simultaneously feed two pouches B to the turret 28.

Figure 4:
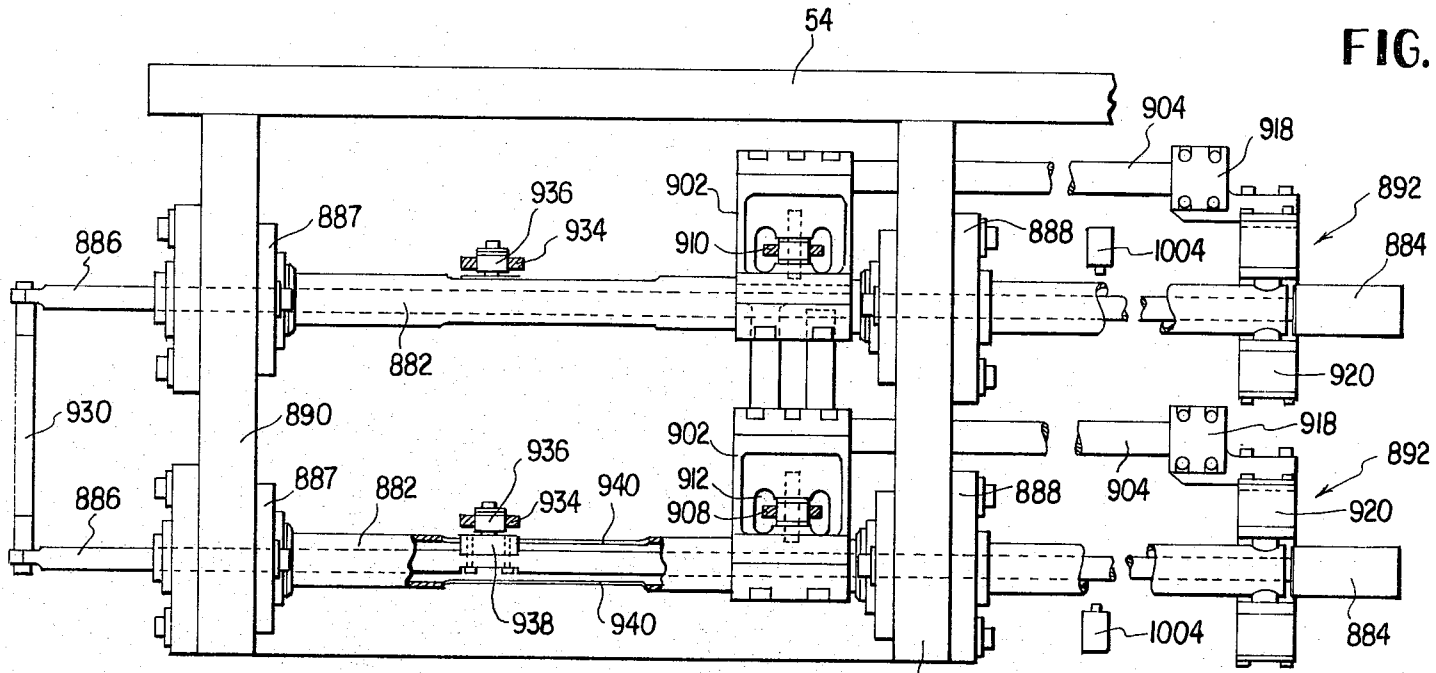
FIG. 4 is a horizontal sectional view taken generally along the line 4—4 of FIG. 3 and shows the two mandrels of the mandrel assembly.

Reference is now made to FIGS. 3 and 4 wherein it will be seen that to the left of the mandrel guide sleeve 888 is clamped to the mandrel 892 a feed member 902 which carries a support rod 904 which passes through the adjacent support member 890 and carries at the forward end thereof the tube gripper 892. The feed members for the two mandrels 882 are in side-by-side relation and are interconnected by a sliding guide assembly 906 which prevents relative rotation of the tubes 882.

Figure 6:
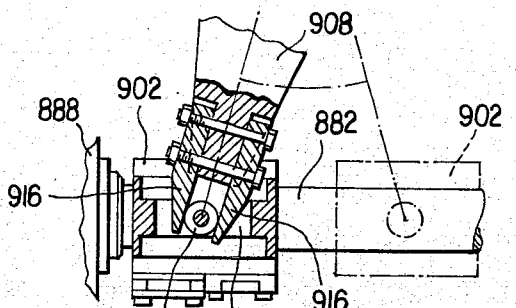
FIG. 6 is an enlarged fragmentary vertical sectional view taken generally along the line 6—6 of FIG. 5 and shows the manner in which an actuating arm is associated with one of the mandrels.

The feed members 902 are engaged by separate feed arms 908 and 910 which are mounted for oscillatory movement in a manner to be described hereinafter. As is best shown in FIG. 6, each feed member 902 has a central opening 912 therethrough in which there is positioned a follower 914. The follower 914 is positioned between two fingers 916 at the end of a respective feed arm, the feed arm 908 being illustrated.

Figure 7:
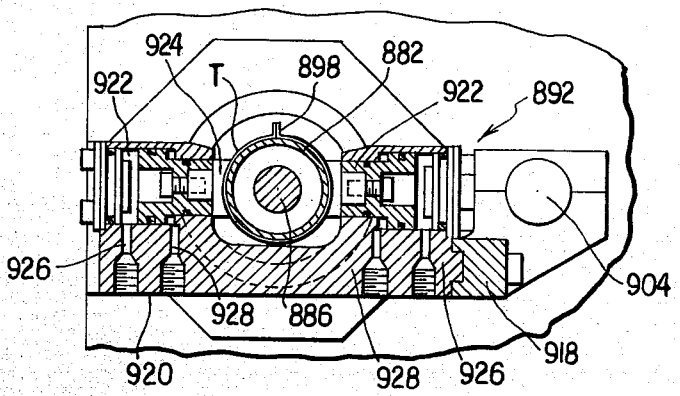
FIG. 7 is an enlarged fragmentary vertical sectional view taken along the line 7—7 of FIG. 3 and shows the general details of a tube gripper associated with one of the mandrels.

Referring now to FIG. 7, it will be seen that one of the grippers 892 is illustrated. The gripper 892 includes a support bracket 918 which carries a generally U-shaped support 920 which has received in the central portion thereof the associated mandrel 882. The support 920 carries diametrically opposite piston and cylinder assemblies 922, each of which carries a gripper member 924 for gripping the tube T on the mandrel 882 in diametrically opposite position for advancement with the advancing mandrel 882.

It will be seen that the piston and cylinder arrangements are of the double acting type and have two separate fluid passages 926, 928 coupled thereto.

It will be seen that the support rods 886 for the mandrel extensions 884 extend through the left ends of the mandrels 882 and are connected together for movement in unison by a connector 930. However, while the mandrel extensions 884 move in unison, they are separately reciprocated by drive arms 932 which have bifurcated ends 934 engaged over followers 936. Each follower 936 is carried by a support 938 mounted on an intermediate portion of the support rod 886. The support 938 extends through a longitudinal slot 940 in the mandrel 882, there being a like slot 940 on the diametrically opposite side of the mandrel 882.

The drive arms 932 are mounted on a single control shaft 942 which is rotatably journalled in a support bearing 944 carried by the wall 54.

Figure 8:
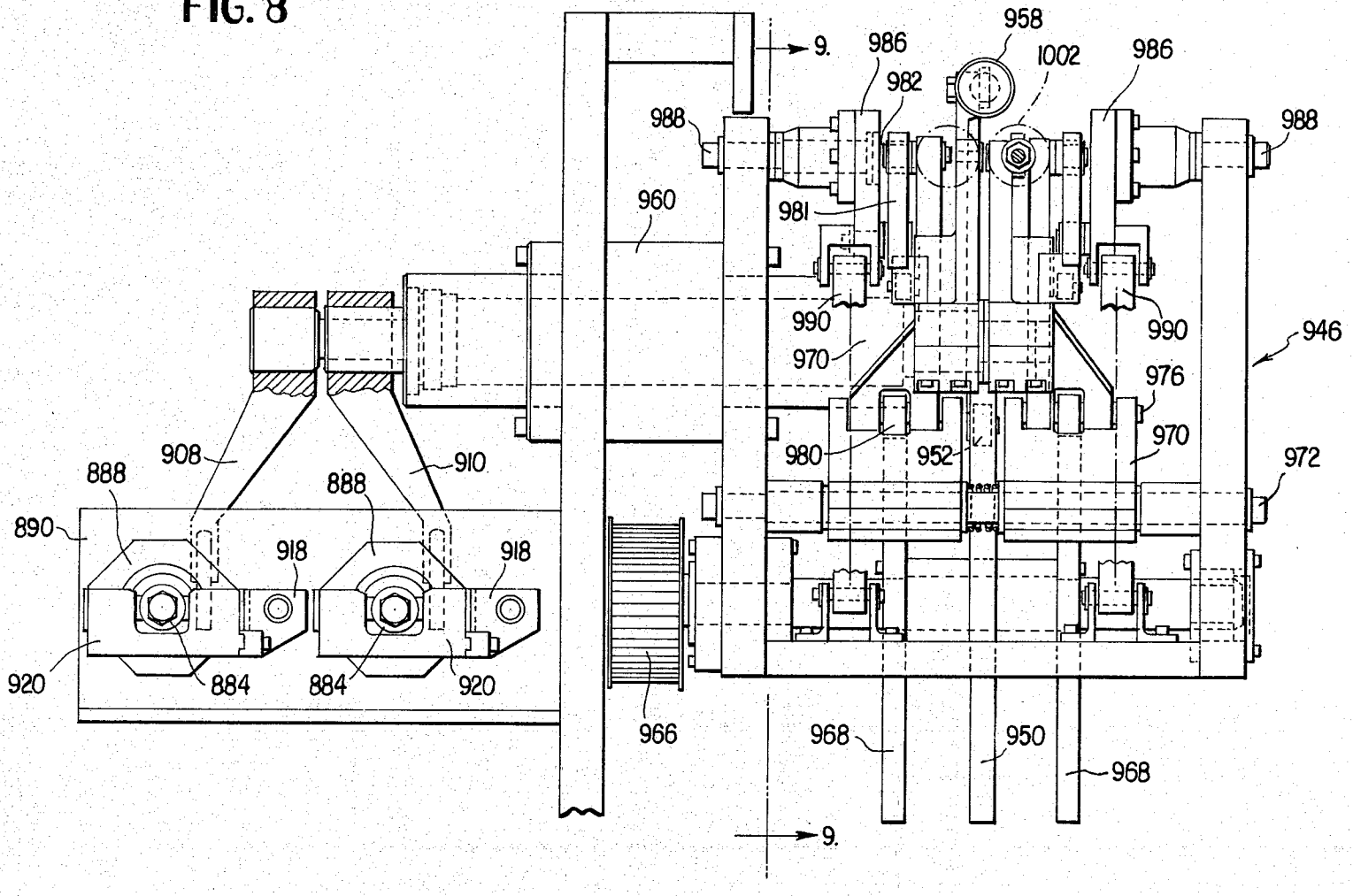
FIG. 8 is a transverse vertical sectional view taken generally along the line 8—8 of FIG. 3 with parts broken away and shown in section for purposes of clarity.
Figure 9:
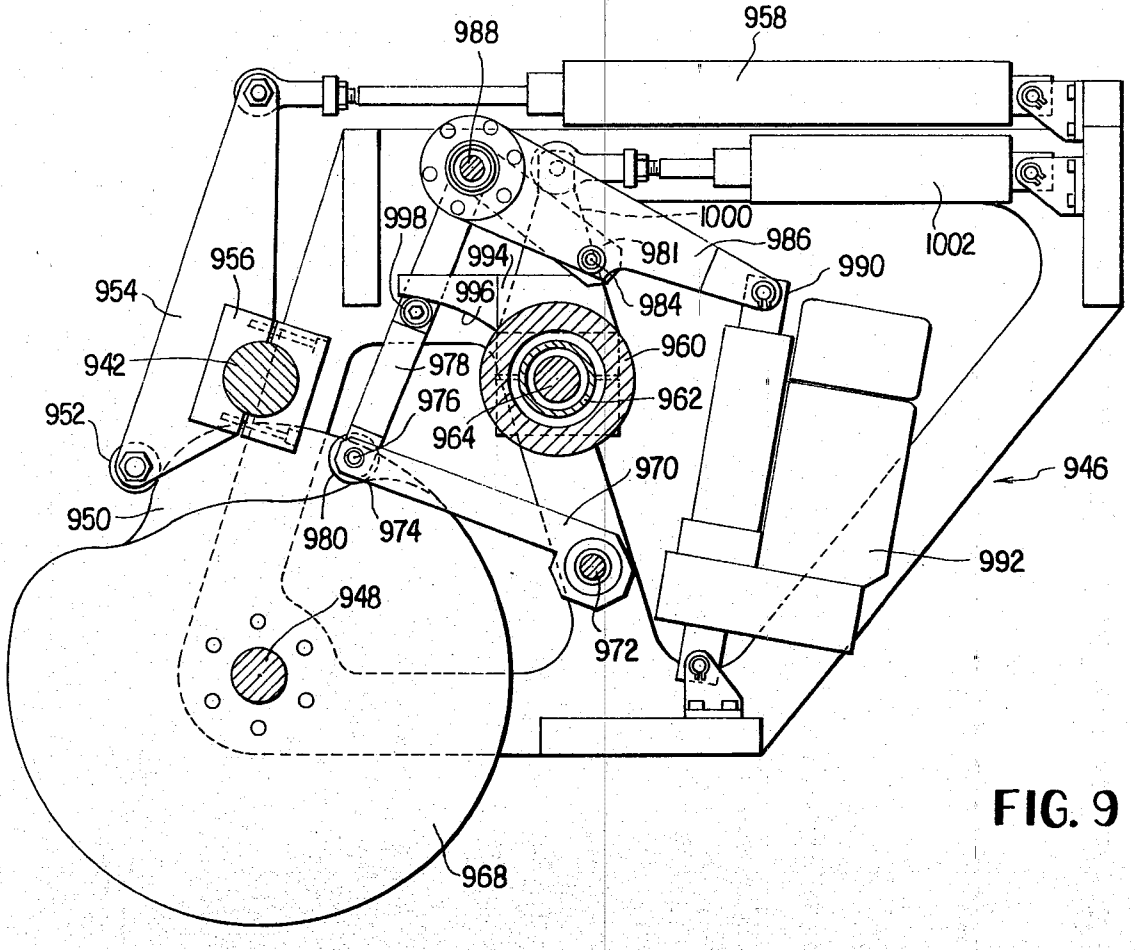
FIG. 9 is a longitudinal vertical sectional view taken generally along the line 9—9 of FIG. 8 and shows specifically the details of cam actuated drives.

With reference to FIG. 9, it will be seen that there is illustrated a frame assembly 946 which, as is best shown in FIG. 8, is secured to the opposite surface of the wall 54. The frame assembly 946 carries a drive shaft 948 on which there is mounted an intermediate cam 950. The cam 950 engages a cam follower 952 carried by a lever 954 which has an intermediate portion thereof secured to the shaft 942 by a clamp 956. The opposite end of the lever 954 has coupled thereto a fluid cylinder 958 carried by the frame 946 for constantly urging the cam follower 952 against the cam 950 under controlled pressure.

There is illustrated carried by the wall 54 and the frame 946 a bearing assembly 960 which supports for oscillation an outer shaft 962 and an inner shaft 964 which carry the feed arms 908 and 910, respectively. The mounting of the feed arms 908, 910 on these two shafts is best shown in FIG. 8.

Each of the shafts 962 and 964 is oscillated in the same manner. Accordingly, the drive means for only the shaft 962 will be described in detail here.

The drive shaft 948, which is shown in FIG. 8 as being driven from other mechanism of the machine by way of a drive sprocket 966 carries two outside cams 968. There is mounted adjacent each of the cams 968 a linkage which includes a first lever 970 pivotally mounted on the frame 946 by means of a pivot pin 972. The opposite end of the lever 970 is bifurcated as at 974 and carries a pivot pin 976. The pivot pin 976 carries a bifurcated end of a second lever 978 which has mounted within its bifurcations and on the pivot pin 976 a cam follower 980 which engages the cam 968.

The opposite end of the second lever 978 is pivotally connected to a terminal lever 981 by a pivot pin 982 (FIG. 8). The terminal lever 981 has a terminal pivot 984 which is carried by an intermediate portion of a terminal lever 986. The terminal lever 986 has one end thereof pivotally mounted on a fixed pivot 988 while the opposite end thereof is pivotally connected to an adjustable support 990. The support 990 is selectively extensible or retractable and is preferably in the form of a motor driven screw mounted assembly although any type of positioning mechanism 992 may be provided for the support 990.

The shaft 992 carries a positioning lever 994 which is provided with a cam surface 996 engaged with a cam follower 998 carried by an intermediate portion of the second lever 978.

A lever 1000 is also carried by the shaft 992 and has a free end engaged by a piston rod of a fluid cylinder 1002 which acts to constantly urge the cam surface 992 against the cam follower 998 and in a similar manner to urge the cam follower 980 with the cam 968 under pressure.

As stated above, there is a second cam 968 on the opposite side of the intermediate cam 950 for oscillating the shaft 964. Like linkage and adjusting mechanism connects the second of the cams 968 to the shaft 964.

It is to be understood that the cams 950 and 968 serve to normally reciprocate the mandrels 882 and mandrel extension 884 in sequence to produce the advance and retraction thereof so as to effect the feeding of the tube T in the manner shown in FIGS. *2a–2e*. However, associated with each of the mandrels 882 is a detector 1004 for detecting the position of indicia printed on the web W. It is to be understood that the indicia on each of the pouches B is to be aligned with the pouch. The detectors 1004 may be in the form of electric eyes or any other type of detectors. Further, the detectors 1004 are coupled in a customary manner to the positioning mechanisms 992 so as to advance or retract the support 990 to advance the respective mandrel 882 either a lesser or greater amount so as to assure the desired indicia orientation.

Although only a preferred embodiment of the mandrel assembly has been specifically illustrated and described herein, it is to be understood that minor variations may be made therein without departing from the spirit and scope of the invention as defined by the appended claims.

I claim:

1. In a pouch forming apparatus for forming pouches from a printed web, a tube forming mandrel assembly, said mandrel assembly comprising a reciprocating mandrel, clamp means associated with said mandrel for periodically clamping a tube portion to said mandrel for movement therewith to advance an associated tube, drive means for repeatedly advancing and retracting said mandrel, and means for varying the advance stroke of said mandrel in response to actuation of said drive means to maintain registration of printing on said web with formed pouches.

2. A mandrel assembly according to claim 1 wherein said drive means includes a cam actuated lever linkage including a lever with a terminal pivot, and said means for varying the mandrel advance stroke including means for changing the location of each terminal pivot.

3. A mandrel assembly according to claim 2 wherein said terminal pivot location changing means includes an extensible support.

4. A mandrel assembly according to claim 2 wherein said terminal pivot location changing means includes a control lever mounted on a fixed pivot and carrying said terminal pivot spaced from said fixed pivot, and positioning means for selectively pivoting said control lever about said fixed pivot.

5. A mandrel assembly according to claim 4 wherein said positioning means includes an extensible support.

6. A mandrel assembly according to claim 1 wherein said advance stroke varying means includes detector means for detecting the position of printing on the printed web.

7. A mandrel assembly according to claim 6 wherein there are two reciprocating mandrels each having its own separate drive means, and there being a separate detector for each drive means.

8. A mandrel assembly according to claim 2 wherein said linkage is a three lever linkage including the first mentioned lever being a terminal lever, and there being a first lever having a cam follower, and a second lever extending between said first lever and said terminal lever, and said second lever carrying a shaft actuator.

9. A mandrel assembly according to claim 8 wherein there is a connecting pivot between said first and second levers, and said cam follower is carried by said connecting pivot.

10. A mandrel assembly according to claim 8 wherein there is a drive shaft, a lever carried by said drive shaft having a cam surface, and said shaft actuator being a follower engaging said cam surface.

11. A mandrel assembly according to claim 1 wherein said mandrel has a terminal end, a mandrel extension positioned adjacent said mandrel terminal end, a support rod carried by said mandrel and supporting said mandrel extension for movement independently of said mandrel.

12. A mandrel assembly according to claim 11 together with a separate drive for said mandrel extension.

* * * * *